US006355184B1

(12) United States Patent
Crevasse et al.

(10) Patent No.: US 6,355,184 B1
(45) **Date of Patent: *Mar. 12, 2002**

(54) METHOD OF ELIMINATING AGGLOMERATE PARTICLES IN A POLISHING SLURRY

(75) Inventors: Annette M. Crevasse, Apoka; William G. Easter, Orlando; John A. Maze, Orlando; Sailesh M. Merchant, Orlando; Frank Miceli, Orlando, all of FL (US)

(73) Assignee: Agere Systems Guardian Corp., Orlando, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/427,306

(22) Filed: Oct. 26, 1999

Related U.S. Application Data

(63) Continuation-in-part of application No. 09/083,072, filed on May 21, 1998, now Pat. No. 6,024,829.

(51) Int. Cl.[7] ..... H01L 21/00; H05H 1/00

(52) U.S. Cl. ..... 216/93; 216/88; 216/89; 438/692; 438/691; 156/345

(58) Field of Search ..... 216/88–93; 438/690–693; 156/345; 134/1, 1.3; 366/2

(56) References Cited

U.S. PATENT DOCUMENTS 5,201,958 A * 4/1993 Breunsbach et al. ..... 134/1
5,531,861 A * 7/1996 Yu et al. ..... 156/636.1
5,664,990 A * 9/1997 Adams et al. ..... 451/60
5,755,614 A * 5/1998 Adams et al. ..... 451/60

FOREIGN PATENT DOCUMENTS

JP 1187284 * 3/1999

* cited by examiner

*Primary Examiner*—Gregory Mills
*Assistant Examiner*—P. Hassanzadeh

(57) ABSTRACT

The present invention, in one embodiment, provides a method for eliminating agglomerate particles in a polishing slurry. In this particular embodiment, the method is directed to reducing agglomeration of slurry particles within a waste slurry passing through a slurry system drain. The method comprises conveying the waste slurry to the drain, wherein the waste slurry may form an agglomerate having an agglomerate particle size. The method further comprises subjecting the waste slurry to energy emanating from an energy source. The energy source thereby transfers energy to the waste slurry to substantially reduce the agglomerate particle size. Substantially reduce means that the agglomerate is size is reduced such that the waste slurry is free to flow through the drain.

4 Claims, 6 Drawing Sheets

*FIG. 2*

| 210 | 220 | 230 | 240 | 250 | 260 | 270 |
|---|---|---|---|---|---|---|
| PRODUCT | ABRASIVE | MEDIUM | CONCENTRATION (PERCENT) | pH | PARTICLE SIZE (MICRONS) | USE |
| MET-200 | ALUMINA | FERRIC NITRATE | 20 | 3.5-4.0 | 1.5 | TUNGSTEN (W) |
| MET-401 | ALUMINA | FERRIC NITRATE | 20 | 3.5-4.0 | 1.15 | COPPER (CU) |
| MET-202 | ALUMINA | FERRIC NITRATE | 20 | 3.5-4.0 | 0.12 | ALUMINUM OR W |
| MET-302 | ALUMINA | FERRIC NITRATE | 20 | 3.5-4.0 | 0.12 | TUNGSTEN |
| KLEBOSOL® 30N50 | AMORPHOUS SILICA | AMMONIUM HYDROXIDE | 30 | 10 | 0.05 | DIELECTRIC-TEOS, BPSG, ETC. |
| KLEBOSOL® 30N50 pHN | AMORPHOUS SILICA | AMMONIUM HYDROXIDE | 30 | 11 | 0.05 | DIELECTRIC |
| KLEBOSOL® 30N25 | AMORPHOUS SILICA | AMMONIUM HYDROXIDE | 30 | 10 | 0.025 | DIELECTRIC |
| KLEBOSOL® 30N12 | AMORPHOUS SILICA | AMMONIUM HYDROXIDE | 30 | 10 | 0.012 | DIELECTRIC |
| KLEBOSOL® 30H50 | AMORPHOUS SILICA | PROPRIETARY H+ | 30 | 2 | 0.05 | SPECIAL DIELECTRIC SURFACING |
| KLEBOSOL® 30H25 | AMORPHOUS SILICA | PROPRIETARY H+ | 30 | 2 | 0.025 | POST-METAL DIELECTRIC |
| KLEBOSOL® 20H12 | AMORPHOUS SILICA | PROPRIETARY H+ | 20 | 2 | 0.012 | POST-METAL DIELECTRIC |
| KLEBOSOL® 1498 | AMORPHOUS SILICA | PROPRIETARY | 30 | 7 | 0.05 | POLYSILICON |
| KLEBOSOL® 50R50 | AMORPHOUS SILICA | SODIUM HYDROXIDE | 50 | 9 | 0.05 | STOCK REMOVAL |
| KLEBOSOL® PL1501 | AMORPHOUS SILICA | POTASSIUM HYDROXIDE | 30 | 11 | 0.05 | DIELECTRIC |
| KLEBOSOL® PL1508 | AMORPHOUS SILICA | AMMONIUM HYDROXIDE | 30 | 11 | 0.05 | DIELECTRIC |

NOTE: KLEBOSOL IS A REGISTERED TRADEMARK OF SOCIETE FRANCAISE HOECHST

METHOD OF ELIMINATING AGGLOMERATE PARTICLES IN A POLISHING SLURRY

CROSS-REFERENCE TO RELATED APPLICATION

This application is a continuation in part of U.S. patent application Ser. No. 09/083,072, filed on May 21, 1998, U.S. Pat. No. 6,024,829 entitled "A Method of Eliminating Agglomerate Particles in a Polishing Slurry" to Easter, et al., which is incorporated herein by reference.

TECHNICAL FIELD OF THE INVENTION

The present invention is directed, in general, to a method of semiconductor wafer fabrication and, more specifically to a method of eliminating agglomerate particles in a polishing slurry used for polishing a semiconductor wafer.

BACKGROUND OF THE INVENTION

Today's semiconductor technology is rapidly forcing device sizes below the 0.5 micron level, even to the 0.25 micron size. With device sizes on this order, even higher precision is being demanded of the processes which form and shape the devices and the dielectric layers separating the active devices. In the fabrication of semiconductor components, the various devices are formed in layers upon an underlying substrate typically composed of silicon, germanium, or gallium arsenide. The various discrete devices are interconnected by metal conductor lines to form the desired integrated circuits. The metal conductor lines are further insulated from the next interconnection level by thin films of insulating material deposited by, for example, CVD (Chemical Vapor Deposition) of oxide or application of SOG (Spin On Glass) layers followed by fellow processes. Holes, or vias, formed through the insulating layers provide electrical connectivity between successive conductive interconnection layers. In such microcircuit wiring processes, it is highly desirable that the insulating layers have a smooth surface topography, since it is difficult to lithographically image and pattern layers applied to rough surfaces.

One semiconductor manufacturing process, chemical/mechanical polishing (CMP), is used to provide the necessary smooth semiconductor topographies. CMP can be used for planarizing: (a) insulator surfaces, such as silicon oxide or silicon nitride, deposited by chemical vapor deposition; (b) insulating layers, such as glasses deposited by spin-on and reflow deposition means, over semiconductor devices; or (c) metallic conductor interconnection wiring layers such as tungsten. Semiconductor wafers may also be planarized to: control layer thickness, define vias, remove a hardmask, remove other material layers, etc. Significantly, a given semiconductor wafer may be planarized several times, such as upon completion of each metal layer. For example, following via formation in a dielectric material layer, a metallization layer is blanket deposited and then CMP is used to produce planar metal vias or contacts.

Briefly, the CMP process involves holding and rotating a thin, reasonably flat, semiconductor wafer against a rotating polishing surface. The polishing surface is wetted by a chemical slurry, under controlled chemical, pressure, and temperature conditions. The chemical slurry contains a polishing agent, such as alumina or silica, which is used as the abrasive material. Additionally, the slurry contains selected chemicals which etch or oxidize selected surfaces of the wafer to prepare them for removal by the abrasive.

The combination of both a chemical reaction and mechanical removal of the material during polishing, results in superior planarization of the polished surface. In this process it is important to remove a sufficient amount of material to provide a smooth surface, without removing an excessive amount of underlying materials. Accurate material removal is particularly important in today's submicron technologies where the layers between device and metal levels are constantly getting thinner.

One problem area associated with chemical/mechanical polishing is in the area of slurry consistency. The polishing slurry is a suspension of a mechanical abrasive in a liquid chemical agent. The mechanical abrasive, typically alumina or amorphous silica, is chosen having a design particle size specifically to abrade the intended material. The desired particle size is chosen in much the same way that a sandpaper grade is chosen to give a particular smoothness of finish on wood, metal, or paint. If the particle size is too small, the polishing process will proceed too slowly or not at all. However, if the particle size is too large, desirable semiconductor features may be significantly damaged by scratching or unpredictable removal rates. Unfortunately, because the slurry is a suspension rather than a solution, methods such as continual flow or high speed impellers must be used to try to maintain a uniform suspension distribution. The slurry particles tend to form relatively large clumps when compared to semiconductor device sizes. While these clumps of abrasive can grow to significant size, e.g., 0.1 $\mu$m to 30 $\mu$m, depending in part upon their initial abrasive particle size, they retain their ability to abrade the semiconductor wafer surface. The agglomeration problem is most apparent when the slurry is allowed to stand. If the slurry is allowed to stand in the supply line for any appreciable time, the agglomeration begins and the slurry can even gel, causing clogs in the supply line or unpredictable removal rates. This results in the need to stop the processing and flush the supply line. Of course, once the supply line is flushed, the stabilized slurry must be reflowed through the line, forcing any residual water from the line. This entire process is time consuming and ultimately very expensive when the high cost of the wasted slurry and the lost processing time is considered. Agglomeration is especially a problem in metal planarization slurries.

To help alleviate this agglomeration problem, the conventional approach has been to keep the slurry flowing in a loop and to perform a coarse filter of the slurry while it is in the loop. To supply the slurry to the polishing platen, the loop is tapped, and the slurry is subjected to a point-of-use, final filter just before it is applied to the polishing platen. However, as the final filter strains out the larger particles, the filter becomes clogged, raising the flow pressure required and necessitating a filter change or cleaning operation. The increased pressure may deprive the polishing platen of slurry and endanger the planarization process. Cleaning or changing the filter clearly interrupts the CMP processing. Naturally, cleaning or replacing the filter is both time consuming and costly. Further, as the filters are extremely fine (capable of passing particles less than about 10 $\mu$m to 14 $\mu$m in size), the filters themselves represent a significant cost. Additionally, when the processing is stopped to clean/replace the filter, the slurry supply line must be flushed with water to prevent even more agglomerate from forming. This flushing water initially dilutes the slurry when processing resumes, further delaying the CMP process and affecting processing parameters. Unfortunately, even when the filters are flushed regularly, the filters may only last for a period of a few days or even hours, depending upon the daily processing schedule. Furthermore, these filters still allow particles that have particle sizes larger than the intended design particle size to reach the polishing surface.

Another problem area associated with chemical/mechanical polishing is in the area of slurry agglomeration in the slurry drain system. Unfortunately, the abrasive particles in the waste slurry tend to agglomerate also in the drain, forming relatively large clumps. This is a result of the slurry being gravity drained to a waste slurry receptacle at room temperature whereas unused slurry is held at a controlled temperature above room temperature and pumped. The lower room temperature contributes to the waste slurry agglomeration tendency, and the larger agglomerated particles tend to collect in couplings, bends, and internally rough areas of the drain. The agglomeration problem is very apparent if the slurry is allowed to stand in the drain for any appreciable time. When this happens, the drain line may clog. This may require that the processing be stopped and the drain line be flushed. This entire process is time consuming and ultimately very expensive in lost processing time. Agglomeration is especially a problem in metal planarization slurries.

To help alleviate this agglomeration problem in drains, the conventional approach has been to use larger inside diameter drains and to avoid or limit the number of sharp bends in the drain line. Of course, this approach is limited by space constraints in the clean room and does not directly address the problem.

Accordingly, what is needed in the art is a slurry transport system and method of use thereof which efficiently breaks up the CMP slurry agglomerate, and returns the slurry particulate matter substantially to the design particle size.

SUMMARY OF THE INVENTION

To address the above-discussed deficiencies of the prior art, the present invention, in one embodiment, provides a method for eliminating agglomerate particles in a polishing slurry. In this particular embodiment, the method is directed to reducing agglomeration of slurry particles within a waste slurry passing through a slurry system drain. The method comprises conveying the waste slurry to the drain, wherein the waste slurry may form an agglomerate having an agglomerate particle size. The method further comprises subjecting the waste slurry to energy emanating from an energy source. The energy source thereby transfers energy to the waste slurry to substantially reduce the agglomerate particle size. Substantially reduce means that the agglomerate is size is reduced such that the waste slurry is free to flow through the drain.

In a particularly advantageous embodiment, the method further comprises sensing a absorbance of the waste slurry with a absorbance sensor coupled to the drain. The method, in another embodiment, includes cycling off the energy source when the absorbance sensed is a nominal absorbance or less. The method further includes cycling the energy source on when the absorbance sensed is greater than the nominal absorbance. In a further aspect, the nominal absorbance may be less than about 0.5.

In one embodiment, the energy transferred to the waste slurry is heat energy. In one specific aspect of this embodiment, the heat energy is transferred with a heating coil. In an alternative embodiment, the heat energy is transferred with hot water. Transferring heat energy with hot water may include injecting hot water or through conduction. In another embodiment, the energy may be transferred as ultrasonic energy by an ultrasonic wave.

The foregoing has outlined, rather broadly, preferred and alternative features of the present invention so that those who are skilled in the art may better understand the detailed description of the invention that follows. Additional features of the invention will be described hereinafter that form the subject of the claims of the invention. Those who are skilled in the art should appreciate that they can readily use the disclosed conception and specific embodiment as a basis for designing or modifying other structures for carrying out the same purposes of the present invention. Those who are skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which:

FIG. 2 illustrates a table of representative, commercially available slurries from one manufacturer for use with the present invention;

DETAILED DESCRIPTION

To address the deficiencies of the prior art, the present invention provides a unique chemical/mechanical planarization (CMP) slurry delivery system that can eliminate agglomeration that occur in a slurry used in polishing or planarizing a semiconductor wafer. The general method of planarizing the surface of a semiconductor wafer, using CMP polishing, and the new and improved slurry delivery system will now be described in detail. The method may be applied when planarizing: (a) insulator surfaces, such as silicon oxide or silicon nitride, deposited by chemical vapor deposition; (b) insulating layers, such as glasses deposited by spin-on and reflow deposition means, over semiconductor devices; or (c) metallic conductor interconnection wiring layers.

Figure 1A:
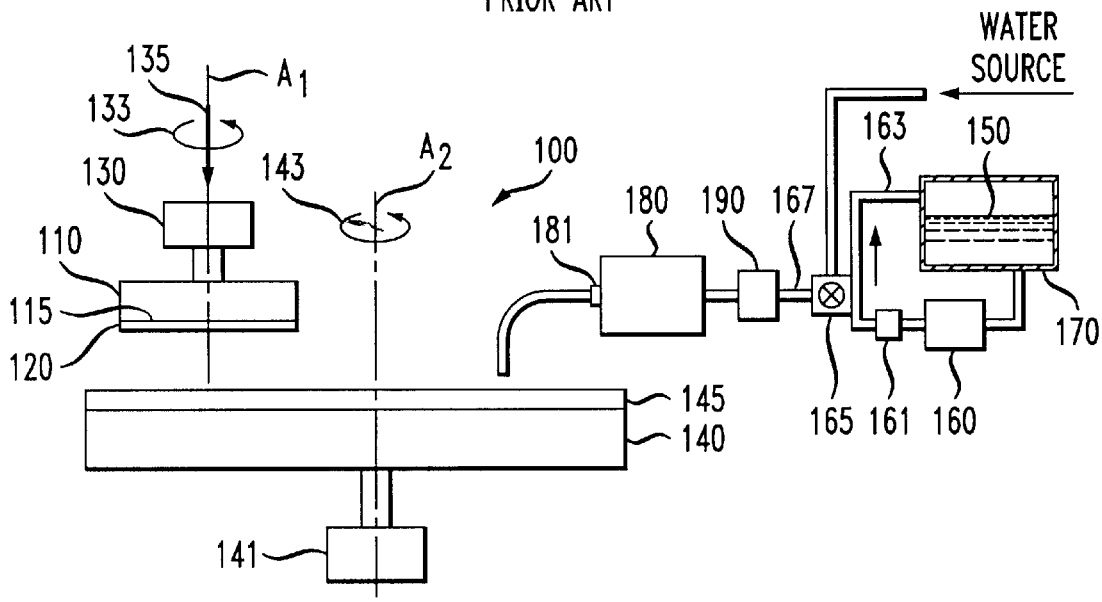
FIG. 1A PRIOR ART
FIGS. 1A and 1B illustrate schematic sectional and plan views of an exemplary embodiment of a conventional chemical/mechanical planarization (CMP) apparatus for use in accordance with the method of the current invention.

Referring initially to FIG. 1A, illustrated is a schematic sectional view of an exemplary embodiment of a conventional chemical/mechanical planarization (CMP) apparatus for use in accordance with the method of the invention. The CMP apparatus 100 may be of a conventional design that includes a wafer carrier or polishing head 110 for holding a semiconductor wafer 120. The wafer carrier 110 typically comprises a retaining ring 115, which is designed to retain the semiconductor wafer 120. The wafer carrier 110 is mounted to a drive motor 130 for continuous rotation about axis $A_1$ in a direction indicated by arrow 133. The wafer carrier 110 is adapted so that a force indicated by arrow 135 is exerted on the semiconductor wafer 120. The CMP apparatus 100 further comprises a polishing platen 140 mounted to a second drive motor 141 for continuous rotation about axis $A_2$ in a direction indicated by arrow 143. A polishing pad 145 formed of a material, such as blown polyurethane, is mounted to the polishing platen 140, which provides a polishing surface for the process. During CMP, a polishing slurry 150, which comprises an abrasive material in a colloidal suspension of either a chemical solution, is dispensed onto the polishing pad 145. In a particularly advantageous embodiment, the abrasive material may be amorphous silica or alumina and has a design, i.e., specification, particle size chosen for the material being polished. During CMP, the polishing slurry 150 is continuously pumped by a main slurry pump 160 from a slurry source tank 170, through a primary filter 161, around a main slurry loop 163, then back to the slurry source tank 170. A portion of the polishing slurry 150 circulating in the main slurry loop 163 is diverted through a three-way solenoid valve 165 to a slurry delivery conduit 167 and pumped to a dispensing mechanism 180, through a final filter 181, and onto the polishing pad 145 by a slurry delivery pump 190. This final filter 181 is only effective in removing agglomerated particles greater than 10 $\mu$m in size. With linewidths at 0.25 $\mu$m and less, these agglomerated particles can severely damage the interconnect circuits. A water source is coupled to the solenoid valve 165 for flushing the slurry delivery conduit 167, the dispensing mechanism 180, and the slurry delivery pump 190.

Figure 1B:
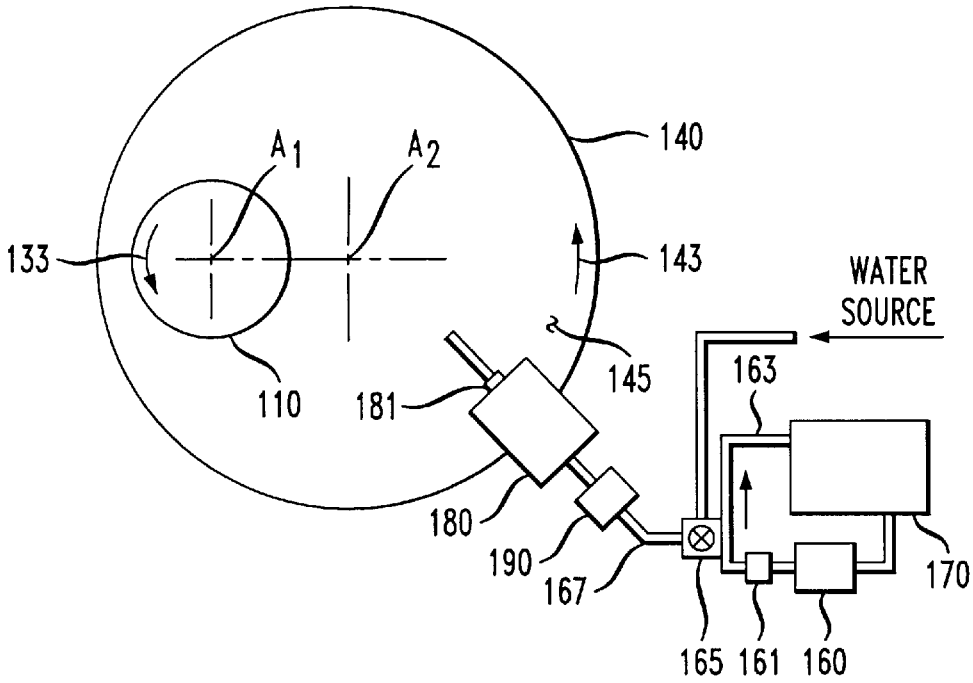
FIG. 1B PRIOR ART

Referring now to FIG. 1B, illustrated is a schematic plan overhead view of the CMP apparatus of FIG. 1A with the key elements shown. The wafer carrier 110 is shown to rotate in a direction indicated by arrow 133 about the axis $A_1$. The polishing platen 140 is shown to rotate in a direction indicated by arrow 143 about the axis $A_2$. Controlled by the three-way solenoid valve 165, the polishing slurry 150 is dispensed onto the polishing pad 145, through the delivery conduit 167 and the dispensing mechanism 180, from the slurry source tank 170. Those who are skilled in the art are familiar with the operation of a conventional CMP apparatus.

Referring now to FIG. 2 with continuing reference to FIGS. 1A and 1B, illustrated is a table of representative, commercially available slurries from one manufacturer for use with the present invention. Commercially available slurries, generally designated 200, with Solution Technology Incorporated product designations (Column 210) shown, comprise abrasive particles of alumina or amorphous silica (Column 220) held in colloidal suspension in selected chemicals (Column 230) at the concentrations (Column 240) and design pH (Column 250) shown. The selected chemicals 230 oxidize or react with a selected material (Column 270) on the semiconductor wafer 120. The oxidized or reacted portion is then removed by a mechanical abrasive process. As can be seen in Column 260, the slurry particles of alumina or amorphous silica 220 have design, i.e., specification, particle sizes ranging from about 0.012 microns to about 1.5 microns.

Figure 3:
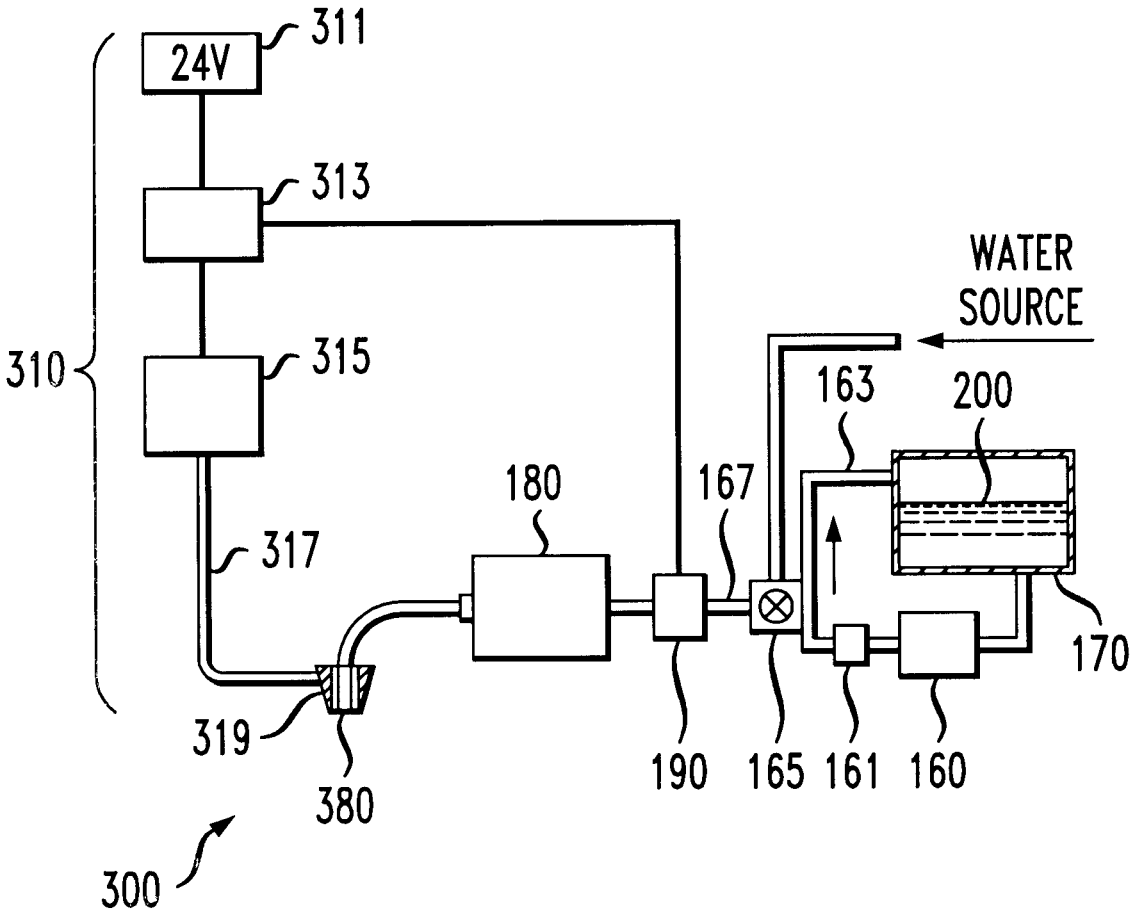
FIG. 3 illustrates a schematic view of one embodiment of an improved CMP slurry delivery system constructed according to the principles of the present invention.

Referring now to FIG. 3, illustrated is a schematic view of one embodiment of an improved CMP slurry delivery system constructed according to the principles of the present invention. An improved CMP slurry delivery system, generally designated 300, comprises the essential elements of the conventional slurry delivery system of FIGS. 1A and 1B, i.e., the slurry source tank 170, the main slurry pump 160, the primary filter 161, the main slurry loop 163, the three-way solenoid valve 165, the slurry delivery conduit 167, the slurry dispensing mechanism 180, and the slurry delivery pump 190.

The improved CMP slurry delivery system 300 may further comprise an energy source 310. In one advantageous embodiment, the energy source 310 comprises a 24 volt power source 311, a power control solenoid 313, a radio frequency generator 315, an RF coax cable 317, and an ultrasonic dispenser nozzle 319. In this embodiment, the 24 volt power source 311 is electrically coupled to the radio frequency generator 315 and the slurry delivery pump 190 through the power control solenoid 313. Thus, the power control solenoid 313 controls electrical power to both the radio frequency generator 315 and the slurry delivery pump 190. The radio frequency generator 313 is further coupled to the ultrasonic dispenser nozzle 319 by the wave guide 317. The ultrasonic dispenser nozzle 319 is mechanically coupled to the output nozzle 380 of the slurry dispensing mechanism 180. In one advantageous embodiment, the radio frequency generator 313 may be capable of emitting ultrasonic energy from about 1 mega Hertz (MHZ) to about 15 MHZ and at a power of about 20 watts. In this embodiment, the ultrasonic energy transmitted to the ultrasonic dispenser nozzle 319 by the wave guide 317 is focused on the slurry 200 that is flowing through the ultrasonic dispenser nozzle 319.

With the equipment of the improved CMP slurry delivery system 300 having been described, its operation will now be discussed in an embodiment in relation to CMP of a semiconductor wafer 120 to planarize a tungsten plug layer. Referring now simultaneously to FIGS. 1A, 1B, and 3, the CMP apparatus is prepared for processing the semiconductor wafer 120. All components of the improved slurry delivery system 300 have been thoroughly cleaned from prior processes. The slurry source tank 170 is filled with an appropriate slurry 200 (e.g., MET-200) from FIG. 2 and the main slurry pump 160 is activated. In this particular embodiment, the semiconductor surface being planarized is a metal, i.e., tungsten, and the alumina abrasive particle size is about 1.5 $\mu$m. In alternative embodiments for planarizing metals, e.g., aluminum, copper, or tungsten, the alumina abrasive particle size may vary from about 0.12 $\mu$m to about 1.5 $\mu$m. In yet other alternative embodiments, the planarizing of a dielectric material, i.e., semiconductor oxides, may employ amorphous silica with particle sizes ranging from about 0.012 $\mu$m to about 0.05 $\mu$m. A person who is skilled in the art will readily appreciate that other abrasives and other particle sizes may likewise be employed with the present invention.

The slurry 200 flows through the primary slurry filter 161 and around the main slurry loop 163, then back to the slurry source tank 170. This flow will continue throughout the CMP processing. Regardless of this flow, however, experience has shown that particle agglomeration occurs. Those particles larger than the actual interstitial spacing of the primary slurry filter 161 will be captured by the filter 161. Agglomerated particles of sizes from about 0.1 $\mu$m to about 30 μm may escape capture by the filter 161, however, and be diverted to the slurry delivery conduit 167 by three-way solenoid valve 165 along with slurry particles of the design size. Moreover, experience has also shown that agglomerated particles form in the slurry delivery conduits even after passing through the filter 161.

Before CMP begins, the power control solenoid 313 is energized and applies electrical power to the slurry delivery pump 190 and the radio frequency generator 315. Agglomerated slurry particles not captured by the primary slurry filter 161 may be in the slurry 200 diverted to the slurry delivery conduit 167 and pumped through the slurry dispensing mechanism 180 by the slurry delivery pump 190.

The energized radio frequency generator 315 delivers radio frequency energy in the form of an ultrasonic wave to the ultrasonic dispenser nozzle 319 through the wave guide 317. The ultrasonic wave is of a frequency from about 1 MHZ to about 15 MHZ and at a power of about 20 watts. When the slurry 200 passes through the ultrasonic dispenser nozzle 319, the ultrasonic wave transmitted from the radio frequency generator 313 is focused by the nozzle 319 on the slurry 200. The ultrasonic energy transferred to the slurry 200 is absorbed by the agglomerated particles. One who is skilled in the art is familiar with the mechanism by which energy in the form of an ultrasonic wave is used to break up particulate material. In a preferred embodiment, the frequency of the ultrasonic energy applied to the slurry 200 is selectively controlled at a frequency between about 1 MHZ and about 15 MHZ, with a power of about 20 watts, so as to reduce the agglomerated particle size to substantially the design particle size for the slurry product 200 in use. The output power and frequency of the radio frequency generator 315 is carefully controlled so that the agglomerated particles are not reduced in size below the design particle size.

Figure 4:
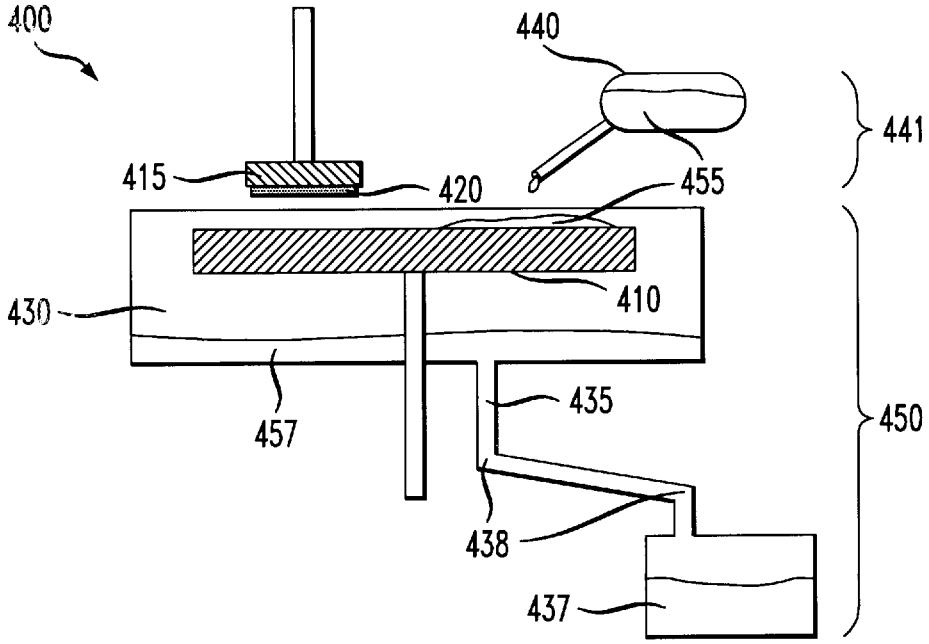
FIG. 4 illustrates a schematic sectional view of an exemplary embodiment of a conventional chemical/mechanical planarization (CMP) apparatus for use in accordance with the method of the present invention.

Referring now to FIG. 4, illustrated is a schematic sectional view of an exemplary embodiment of a conventional chemical/mechanical planarization (CMP) apparatus for use in accordance with the method of the present invention. The CMP apparatus 400 may be of a conventional design that includes a wafer polishing platen 410 and carrier head 415 for polishing a semiconductor wafer 420 in a slurry catch basin 430. The CMP apparatus 400 further comprises a slurry source 440, a fresh slurry delivery system 441, and a waste slurry recovery system 450.

During CMP, slurry 455 is delivered to the polishing platen 410 by the fresh slurry delivery system 440. After polishing the semiconductor wafer 420, the waste slurry 457 collects in the slurry catch basin 430. From the slurry catch basin 430, the waste slurry 457 is routed to a drain 435 to be collected in a waste slurry recovery tank 437. In the drain 435, the waste slurry 457 is conventionally allowed to drain by gravity at room temperature. Because the waste slurry 457 is cooling and not being pumped under pressure, any bend 438 in the drain 435 may be a potential catalyst for the waste slurry 457 to agglomerate to a sizeable particle size. Ultimately, the agglomerated particles may block the drain 435.

Figure 5:
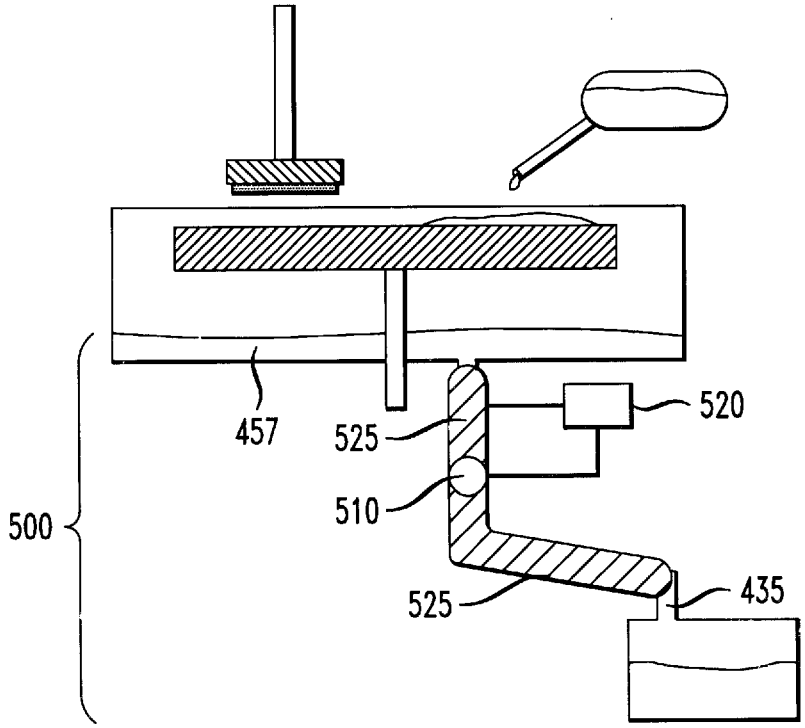
FIG. 5 illustrates the conventional CMP apparatus of FIG. 4 with one embodiment of a waste slurry recovery system constructed according to the principles of the present invention.

Referring now to FIG. 5, illustrated is the conventional CMP apparatus of FIG. 4 with one embodiment of a waste slurry recovery system 500 constructed according to the principles of the present invention. The waste slurry recovery system 500 comprises a absorbance sensor 510 and an energy source 520. In the illustrated embodiment, the energy source 520 is coupled to a heating coil 525 wrapped about the drain 435. The absorbance sensor 510 is coupled to the drain 435, and senses a absorbance of the waste slurry 457. If the absorbance sensed is equal to or greater than a nominal absorbance, the absorbance sensor 510 is programmed to turn the heating coil 525 on. The nominal absorbance is predetermined from empirical data to be the value at which agglomeration becomes a problem that may cause blockage of the drain 435. The nominal absorbance will vary with the type and composition of the slurry. By cycling the heating coil 525 on, the waste slurry 457 is subjected to heat energy that contributes to a higher energy state of the waste slurry 457. With increased temperature, the waste slurry 457 is less likely to agglomerate to the point at which drain 435 blockage occurs, that is, the agglomerated particle size is substantially reduced by the addition of heat energy to the waste slurry. The term "substantially reduced" means that the agglomerated particle size is reduced to a degree that the waste slurry 457 flows freely through the drain 435 to the waste slurry recovery tank 437. If the absorbance sensor 510 determines that the waste slurry absorbance is less than the nominal absorbance, the absorbance sensor 510 cycles the heating coil 525 off, as energy is not needed to prevent blockage.

While the present discussion relates to a absorbance sensor, one who is skilled in the art will readily conceive of other sensors that can perform a similar task, i.e., flow meters, viscosimeters, etc. Such other sensors are considered to be within the greater scope of the present invention.

Figure 6A:
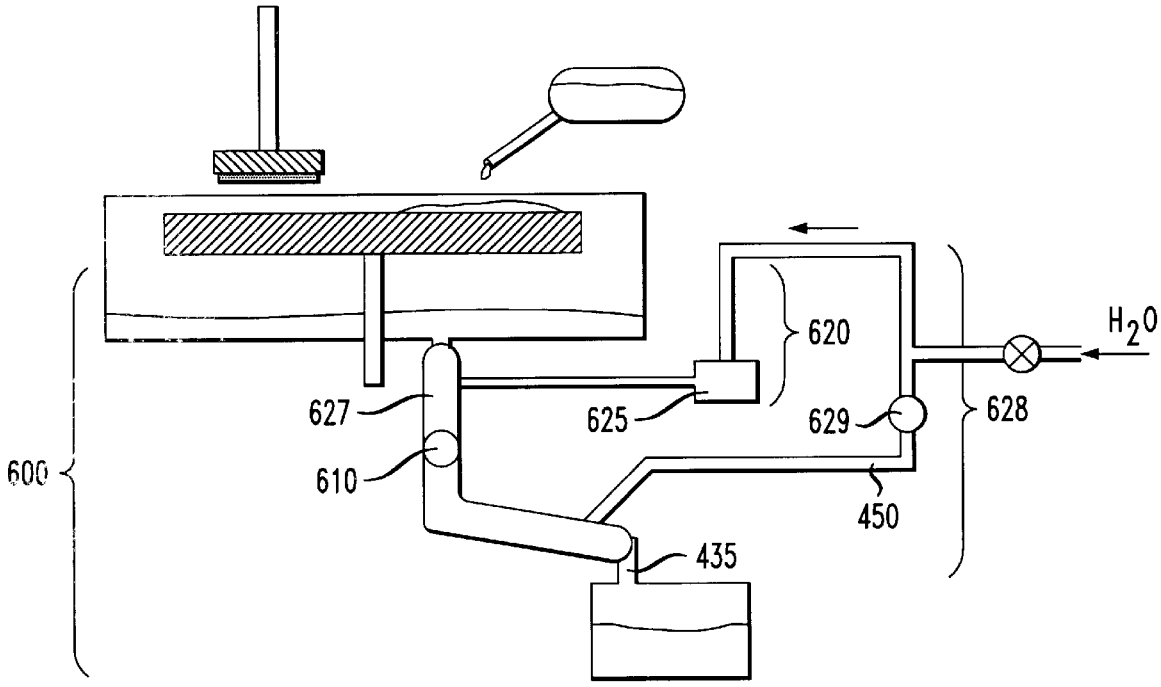
FIG. 6A illustrates the conventional CMP apparatus of FIG. 4 with an alternative embodiment of a waste slurry recovery system.

Referring now to FIG. 6A, illustrated is the conventional CMP apparatus of FIG. 4 with an alternative embodiment of a waste slurry recovery system 600. In this embodiment, the waste slurry recovery system 600 comprises a absorbance sensor 610 and an energy source 620. In the illustrated embodiment, the energy source 620 is a hot water source 625 coupled to the drain 435. Coupling of the hot water source 625 to the drain 435 is by forming a water jacket 627 about the drain 435. If the absorbance sensed is equal to or greater than the nominal absorbance, the absorbance sensor 610 is programmed to circulate hot water through the water jacket 627. This transfers heat energy to the waste slurry 457 by conduction and reduces the probability of slurry particle agglomeration in much the same way as the embodiment of FIG. 5. This embodiment further comprises a recirculation circuit 628 including a recirculation pump 629. By recirculating the hot water, the water and the energy left in the water is not wasted, but rather is efficiently recycled.

Figure 6B:
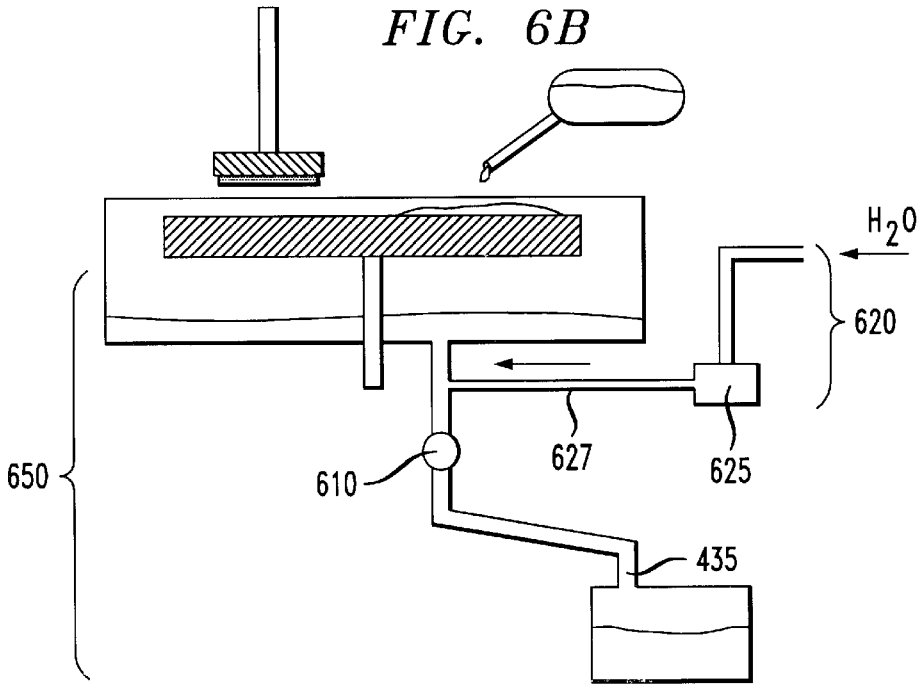
FIG. 6B illustrates the conventional CMP apparatus of FIG. 4 with an alternative embodiment of the waste slurry recovery system of FIG. 6A.

Referring now to FIG. 6B, illustrated is the conventional CMP apparatus of FIG. 4 with an alternative embodiment of the waste slurry recovery system of FIG. 6A. In this embodiment, the waste slurry recovery system 650 comprises a absorbance sensor 610 and an energy source 620. The energy source 620 is a hot water source 625 coupled to the drain 435. The hot water source 625 is coupled to the drain 435 by a hot water line 627. When the absorbance sensed is equal to or greater than the nominal absorbance, the absorbance sensor 610 injects hot water into the drain 435. Heat from the hot water adds energy to the waste slurry 457, thereby increasing the energy state of the waste slurry 457 and reducing the probability of agglomeration of the slurry particles. In addition, the flowing water helps to add kinetic energy to the waste slurry 457, further reducing the probability of agglomeration. Of course, the point of injection may be varied along the drain 435.

Figure 7:
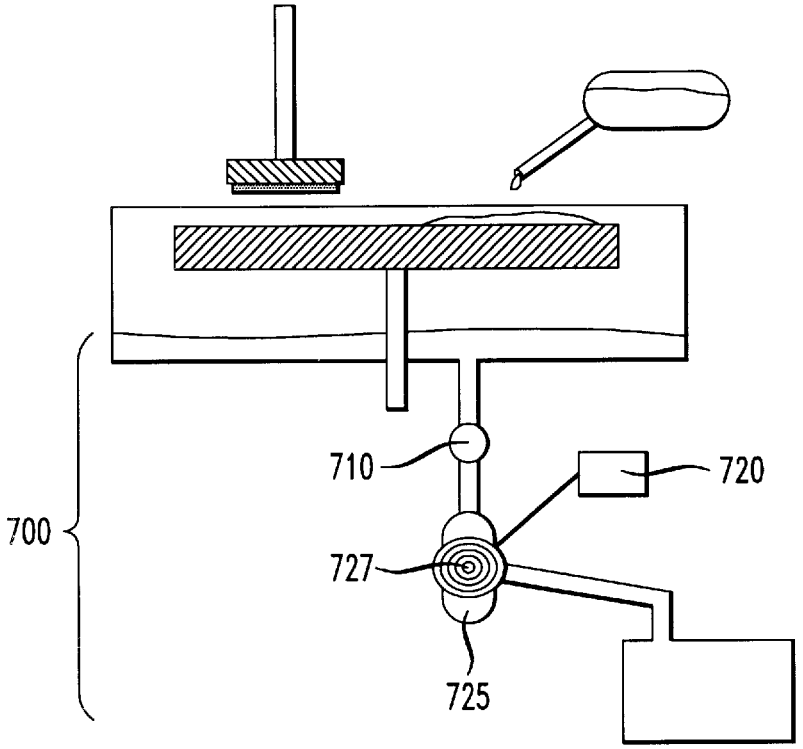
FIG. 7 illustrates the conventional CMP apparatus of FIG. 4 with a second alternative embodiment of the waste slurry recovery system of the present invention.

Referring now to FIG. 7, illustrated is the conventional CMP apparatus of FIG. 4 with a second alternative embodiment of the waste slurry recovery system of the present invention. In this particularly advantageous embodiment, the waste slurry recovery system 700 comprises a absorbance sensor 710 and an energy source 720. The energy source 720 comprises an electrical power source 720 coupled to an ultrasonic transducer 725. When required by the absorbance sensor 710, electrical power is applied by the energy source 720 to the ultrasonic transducer 725 and ultrasonic waves 727 are applied to the waste slurry 457, increasing the energy state of the waste slurry 457 and reducing the probability of agglomeration.

Figure 8:
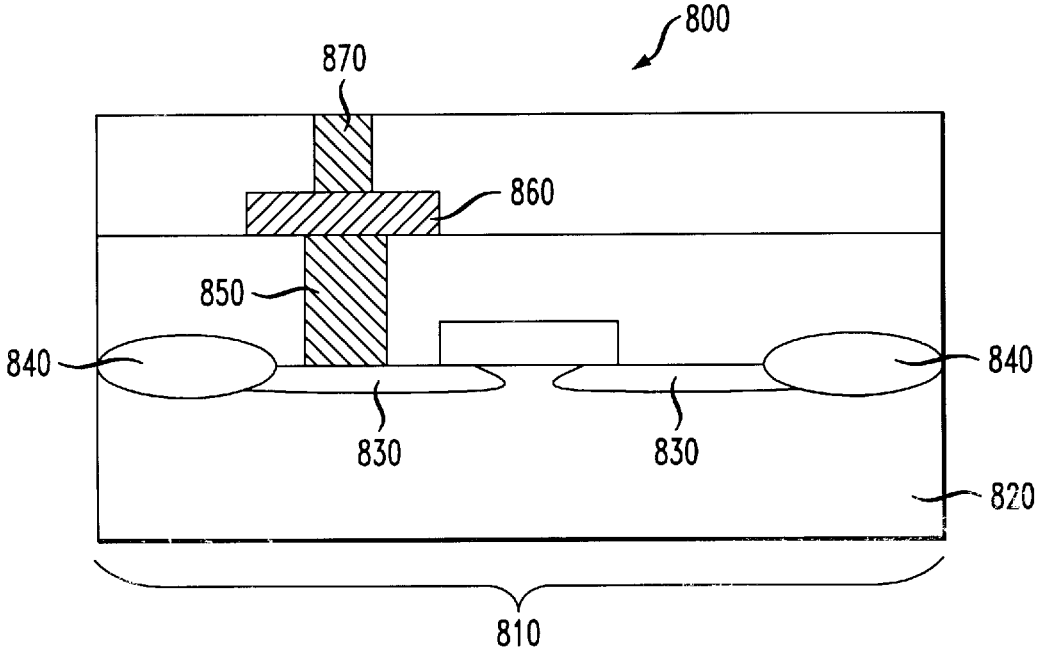
FIG. 8 illustrates a partial sectional view of a conventional integrated circuit that can be manufactured using the slurry recovery system constructed in accordance with the principles of the present invention.

Referring now to FIG. 8, illustrated is a partial sectional view of a conventional integrated circuit 800 that can be manufactured using the slurry recovery system constructed in accordance with the principles of the present invention. In this particular sectional view, there is illustrated an active device 810 that comprises a tub region 820, source/drain regions 830 and field oxides 840, which together may form a conventional transistor, such as a CMOS, PMOS, NMOS or bi-polar transistor. A contact plug 850 contacts the active device 810. The contact plug 850 is, in turn, contacted by a trace 860 that connects to other regions of the integrated circuit, which are not shown. A VIA 870 contacts the trace 860, which provides electrical connection to subsequent levels of the integrated circuit. One who is skilled in the art is familiar with the need to planarize the integrated circuit 800 several times during manufacture. Such planarization may necessitate removal and maintenance of the polishing head with the described invention.

From the foregoing, it is apparent that the present invention provides a method and system for eliminating agglomerate particles in a polishing slurry. The method includes transferring a slurry that has a design particle size from a slurry source to an energy source. In many instances, the slurry forms an agglomerate that can accumulate in the waste slurry drain and cause a blockage. The method further includes subjecting the agglomerate to energy, such as: heat, hot water, or an ultra sonic wave, emanating from the energy source and transferring energy from the energy source to the slurry to reduce the agglomerated particle size to reduce the probability of drain blockage.

Although the present invention has been described in detail, those who are skilled in the art should understand that they can make various changes, substitutions and alterations herein without departing from the spirit and scope of the invention in its broadest form.

What is claimed is:

1. A method for reducing agglomeration of slurry particles in a slurry system drain, comprising:

conveying a waste slurry to a drain, the waste slurry forming an agglomerate in the drain and having an agglomerate particle size;

subjecting the waste slurry within the drain to an ultrasonic energy source as the waste slurry passes through the drain to a slurry recovery tank; and transferring energy from the ultrasonic energy source to the waste slurry within the drain to substantially reduce the agglomerate particle size, the reduced agglomerate particle size reducing the agglomerate in the drain within the slurry recovery tank.

2. The method as recited in claim 1 further comprising sensing a absorbance of the waste slurry with a absorbance sensor coupled to the drain.

3. The method as recited in claim 2 wherein subjecting includes cycling off the subjecting when the sensing discerns a nominal absorbance or less, and cycling on the subjecting when the sensing discerns greater than the nominal absorbance.

4. The method as recited in claim 3 wherein sensing a nominal absorbance includes sensing a nominal absorbance of less.

* * * * *